US008096702B2

(12) United States Patent
Grotell et al.

(10) Patent No.: US 8,096,702 B2
(45) Date of Patent: Jan. 17, 2012

(54) ORNAMENT CONTAINER FOR WATCH

(75) Inventors: Steven Grotell, New York, NY (US); Marc Jenni, Denges (CH)

(73) Assignee: The Avalanche Group, LLC, New York, NY (US)

( * ) Notice: Subject to any disclaimer, the term of this patent is extended or adjusted under 35 U.S.C. 154(b) by 425 days.

(21) Appl. No.: 12/473,905

(22) Filed: May 28, 2009

(65) Prior Publication Data

US 2010/0302915 A1 Dec. 2, 2010

(51) Int. Cl.
*G04B 39/00* (2006.01)

(52) U.S. Cl. ..... 368/294

(58) Field of Classification Search ..... 368/294–296, 368/76, 80, 88, 276, 285, 221–239, 77
See application file for complete search history.

(56) References Cited

U.S. PATENT DOCUMENTS

| | | | | | |
|---|---|---|---|---|---|
| 3,714,775 | A | | 2/1973 | Aoki | 368/291 |
| 4,004,410 | A | | 1/1977 | Kawamata | 368/291 |
| 4,115,994 | A | | 9/1978 | Tomlinson | 368/241 |
| 4,222,228 | A | | 9/1980 | Masui | 368/291 |
| 4,241,442 | A | * | 12/1980 | Grohoski | 368/294 |
| 4,496,248 | A | | 1/1985 | Waki et al. | 368/280 |
| 4,620,798 | A | | 11/1986 | Scarinzi | 368/276 |
| 4,775,964 | A | | 10/1988 | Alessio et al. | 368/67 |
| 5,051,969 | A | | 9/1991 | Huang | 368/223 |
| 5,077,709 | A | | 12/1991 | Feher | 368/229 |
| 5,224,078 | A | * | 6/1993 | Mallin | 368/223 |
| 5,305,292 | A | * | 4/1994 | Reynoso | 368/281 |
| 5,319,616 | A | | 6/1994 | Jolidon | 368/282 |
| 5,519,674 | A | | 5/1996 | Vollert et al. | 368/294 |
| 5,652,736 | A | | 7/1997 | Lee | 368/278 |
| 5,740,130 | A | * | 4/1998 | Grupp et al. | 368/82 |
| 5,751,667 | A | | 5/1998 | Nunes | 368/223 |
| 5,923,623 | A | | 7/1999 | Lee | 368/278 |
| 6,226,232 | B1 | | 5/2001 | Ruchonnet | 368/223 |
| 6,515,942 | B2 | * | 2/2003 | Basturk | 368/223 |
| 6,521,822 | B2 | | 2/2003 | Ito | 136/244 |
| 6,819,632 | B1 | | 11/2004 | Paul | 368/88 |
| 7,300,202 | B2 | | 11/2007 | Mo | 368/309 |
| 2009/0154302 | A1 | | 6/2009 | Smith et al. | 368/285 |

FOREIGN PATENT DOCUMENTS

| | | |
|---|---|---|
| EP | 0327829 | 8/1989 |
| FR | 2713790 | 6/1995 |
| GB | 812487 | 4/1959 |
| GB | 1083159 | 9/1967 |
| JP | 2006-322920 | 11/2006 |
| WO | WO 91/02299 | 2/1991 |
| WO | WO 94/18610 | 8/1994 |

* cited by examiner

*Primary Examiner* — Edwin A. Leon
(74) *Attorney, Agent, or Firm* — Ostrolenk Faber LLP

(57) ABSTRACT

An decorative element container module and a watch assembly incorporating the module are provided. The decorative element case module may include as walls lower and upper crystals, an outer ring for receiving an upper lip of the watch case body so as to secure the outer ring and for securing the upper crystal, and an inner ring including an upper portion for holding the upper crystal and a lower portion for securing the lower crystal. The outer and inner rings may have annular sloping walls to provide a unified reflecting surface for reflecting light to the decorative element container. The components of the module may be secured together and to the watch assembly without adhesive or glue, and may be disassemblable to facilitate removing and/or replacing decorative elements contained inside. The upper and lower crystals may have an anti-static coatings for discharging static electricity.

22 Claims, 4 Drawing Sheets

ORNAMENT CONTAINER FOR WATCH

FIELD OF THE INVENTION

The present application relates to the watches, and particularly to ornament containers or jewelry cases secured inside watches and relates to watch assemblies that include such ornament containers and jewelry cases.

BACKGROUND OF THE INVENTION

Diamonds, gemstones or other decorative elements have been arranged inside jewelry casings and containers inside a watch, a clock or other dial-provided instruments. For example, Feher, U.S. Pat. No. 5,077,709, discloses a jewelry casing filled with a liquid that may have decorative objects floating in it and this decorative casing includes a transparent top and a transparent bottom plate inside a watch. The upper circular glass plate 14 of the object casing rests on an edge wall of the casing and this edge wall is formed integral with the bottom circular metal plate of the casing. The casing is secured into an annular groove of the watch crystal. Similarly, Nunes, U.S. Pat. No. 5,751,667, teaches a decorative object casing positioned below the hands of a watch. The casing contains loose objects that are free to move around the watch face, in this case with the shape of golf tees. The top cover of the casing rests on a ledge of an annular groove of the watch casing. The same annular groove also supports the watch lens. Paul, U.S. Pat. No. 6,819,632, discloses a watch with a decorative object casing below the watch hands. The decorative objects are freely movable around within the casing. The base of the transparent upper cover of the object casing is supported at its perimeter by an annular groove in the rim while the panel at the bottom of the casing is supported by an annular groove in the casing. Further, the idea of having small granules rotated about the visible portion of a clock by mechanical means is taught by Huang, U.S. Pat. No. 5,051,969.

Some known watches provide a sealed decorative container element that is glued into a portion of the watch. Jewelry or decorative elements inside the container cannot be accessed without breaking the seal or the adhesive or glue that secures the ornament container together or that secures the ornament container to the watch assembly. Thus, refilling the decorative objects or granules inside the container or modifying them to suit the needs of the consumer or to keep up with fashion trends is not practical.

The decorative element containers do not blend into the overall appearance of the watch and do not provide a continuous surface to reflect light onto the watch. Moreover, glue or other adhesive provided to secure the parts of the decorative element container together or to secure the parts of the decorative element container to the surrounding watch assembly can interfere with an anti-static coating provided inside the decorative element container to help prevent static electricity that is discharged by contact between diamonds or other decorative objects in the container and the surfaces of the inside of the container.

SUMMARY OF THE INVENTION

A decorative element case module and a watch assembly incorporating a decorative element case module are provided. The watch has a case body and base back, and a watch crystal positioned at the top face of the watch. The decorative element case module according to an aspect of the invention may be positioned under the hour and minute hands of the watch.

The watch may also include a watch backplate underneath the decorative element case module and a watch movement underneath the watch backplate.

The decorative element case module may include a lower crystal configured to be positioned at the watch backplate to form a lower wall of the decorative element case and an upper crystal spaced above the lower crystal and positioned below the watch hands. The upper and lower crystals may thus form the upper and lower walls of the decorative element case. The watch case body may have an inner upper lip that cooperates with an outer ring of the decorative element case module. The outer ring may include an outer recess configured to receive the inner upper lip of the watch case body so as to secure the outer ring, and an inner groove configured to receive the upper crystal. The module may also include an inner ring positioned under the upper crystal inside the outer ring and above the lower crystal. The inner ring may include an upper flat portion configured to hold the upper crystal by sandwiching the upper crystal between the upper flat portion and the inner groove of the outer ring.

The inner ring may be separate from the outer ring, or the inner ring and the outer ring may together be a single integral piece. The outer ring may include a first sloping annular wall extending up from the upper crystal, and the inner ring may include a second sloping annular wall extending down from the upper crystal. The first and second sloping inner walls have the same slope, which provides a unified reflecting surface configured to reflect light entering from above into the decorative element container. The lower crystal may include additional design elements that provide a watch dial appearance.

The outer ring may be positioned such that a topmost portion of the first sloping annular wall is at the watch crystal. Also, the outer ring may include a screw that secures the outer ring to the watch backplate. The inner ring may include an anti-shock gasket.

The module may be secured together and in the watch without adhesive or glue. Also, the decorative element container may be disassemblable when the watch backplate is removed so as to facilitate access for possible removal and/or replacement of decorative elements contained in the decorative element container.

The upper crystal and/or the lower crystal may comprise an anti-static coating which discharges static electricity that may be generated by movement of the decorative elements.

DETAILED DESCRIPTION OF PREFERRED EMBODIMENTS OF THE INVENTION

Figure 9:
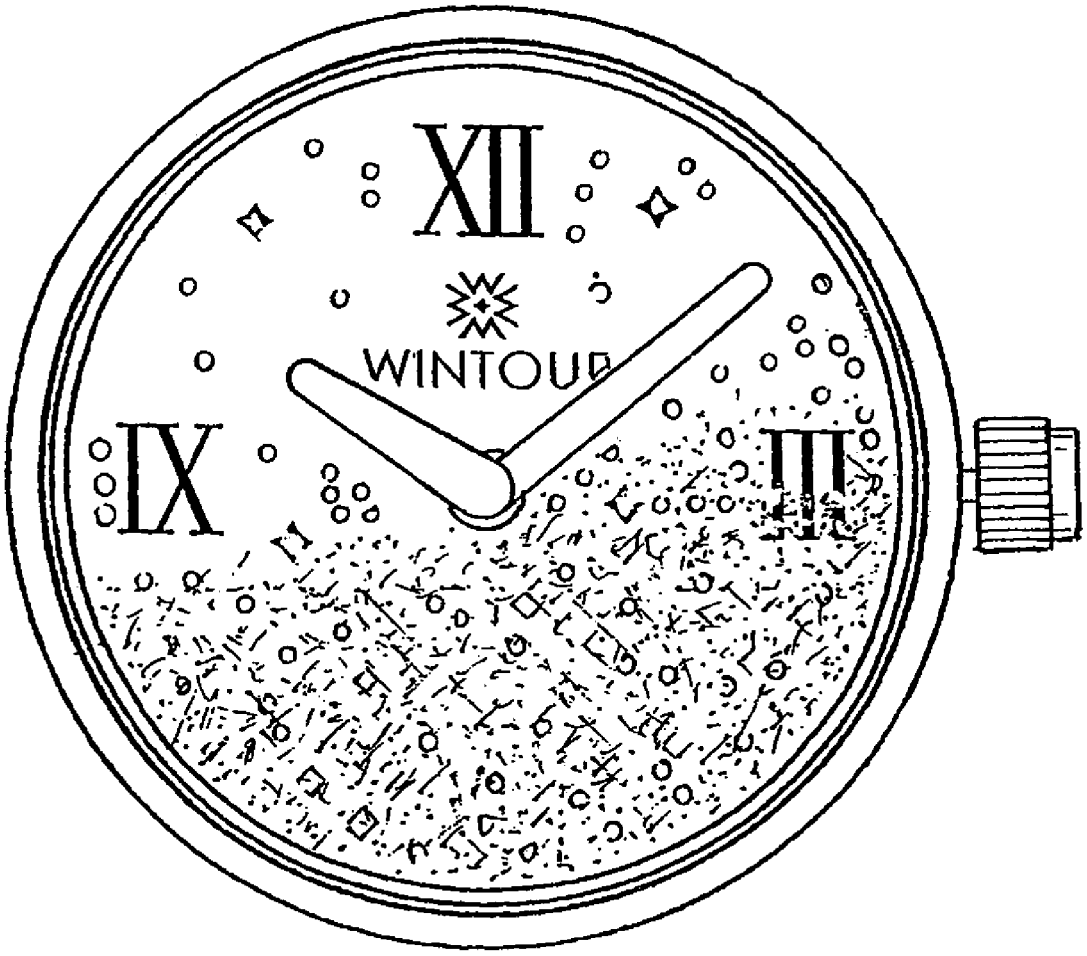
FIG. 9 is a front plan view of the watch face including the decorative element container containing diamond granules according to an aspect of Applicant's invention.

FIG. 9 illustrates the face of a watch including a decorative element container module 40 that holds diamond chips or diamond granules that can move about freely inside the casing between the upper crystal 49 and the lower crystal 59 as the wearer moves the watch 20. The decorative element container module 40 is shown as containing small diamond chips but it could also hold jewelry, diamonds or other precious or semi-precious stones, precious metals, chips or granules of such stones or precious metals or jewelry made from such materials, or other decorative objects or decorative elements, or combinations of any of the foregoing.

Figure 3:
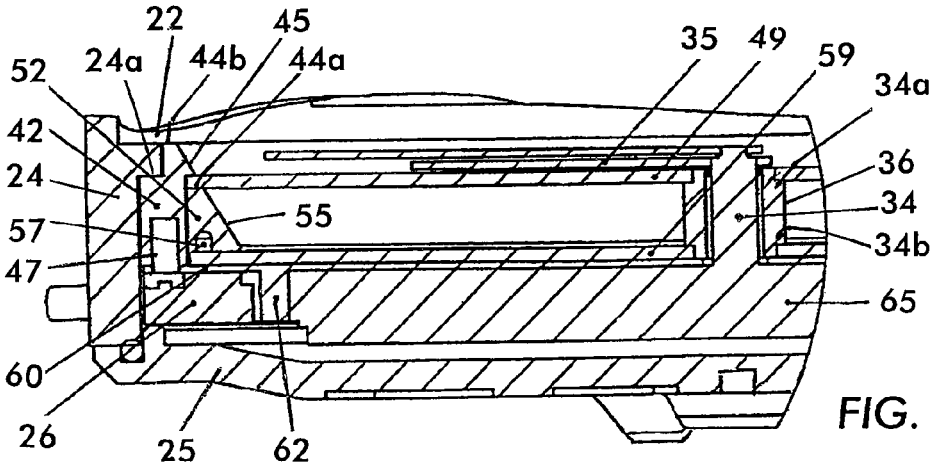
FIG. 3 is detail 3 of the cross-section of the FIG. 2 showing the decorative element container and surrounding watch structures.
Figure 4:
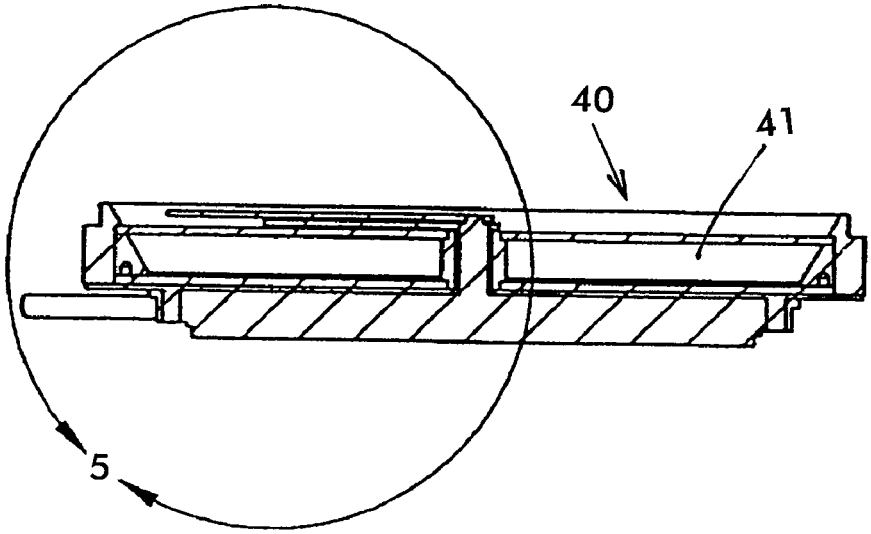
FIG. 4 is a cross-sectional view of a watch assembly including the decorative element container according to an aspect of Applicant's invention.

FIG. 3 shows the watch movement 65, the hour and minute hand pinions 34, and the hour and minute hands 35 of the watch positioned inside watch case body 24 and watch case back 25. The decorative element container module 40 may include upper crystal 49 and lower crystal 59 between which are positioned the decorative elements, such as jewelry, diamond or diamond chips or granules or any other such decorative elemental objects.

FIG. 3 also illustrates inner ring 52 including a bottom portion 56*a* that may rest directly or indirectly on the lower crystal 59, and a top portion 56*b* that supports the top crystal 49. Outer ring 42 is positioned at a periphery of inner ring 52 and includes an inner lip 44*a* which may be provided as a groove or a slot beneath which is supported upper crystal 49. A top portion 44*b* of the outer ring 42 may be positioned at or immediately below the watch crystal position 22.

The module's inner ring 52 and outer ring 42 are positioned so that they may cooperate to sandwich the upper crystal 49 between the top portion 56*b* of inner ring 52 and beneath the upper lip 44*a* of outer ring 42. Inner ring 52 may also serve to secure the lower crystal 59 of the module 40 by sandwiching the lower crystal 59 in between the bottom portion 56*a* of inner ring 52 of the module 40 and the back plate 60 of the watch.

Also, outer ring 42 has an outer recess 43 which may be provided as a receding lip or annular slot that may mate with upper inner lip 24*a* of the case back 24 of the watch. Thus, inner ring 52 and outer ring 42 can be positioned such that they secure the upper crystal 49 and lower crystal 59. Thus, inner ring 52 may serve also to close the decorative element case 41 so as to secure inside the contents.

Figure 6:
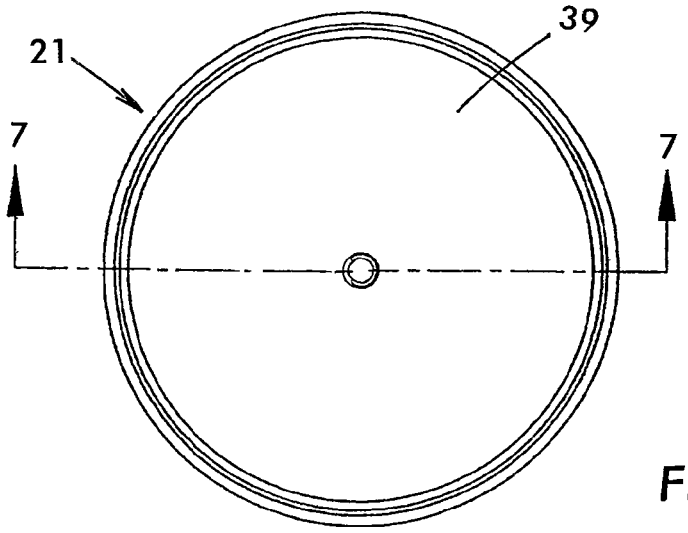
FIG. 6 is a front plan schematic view of the watch face with an empty decorative element container according to an aspect of Applicant's invention.
Figure 7:
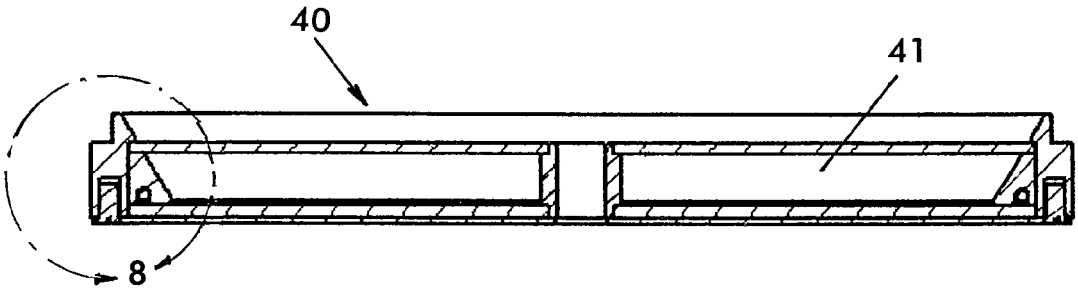
FIG. 7 is a cross-sectional view taken at line 7-7 of FIG. 6 and illustrating the decorative element container according to an aspect of Applicant's invention.

FIG. 7 illustrates the decorative element container module 40 including the decorative element case 41 illustrated in a cross-sectional view taken along line 7-7 of FIG. 6. FIG. 6 is a schematic illustration of a front plan view of a watch face 21 with the decorative element case module 40 inside.

Figure 5:
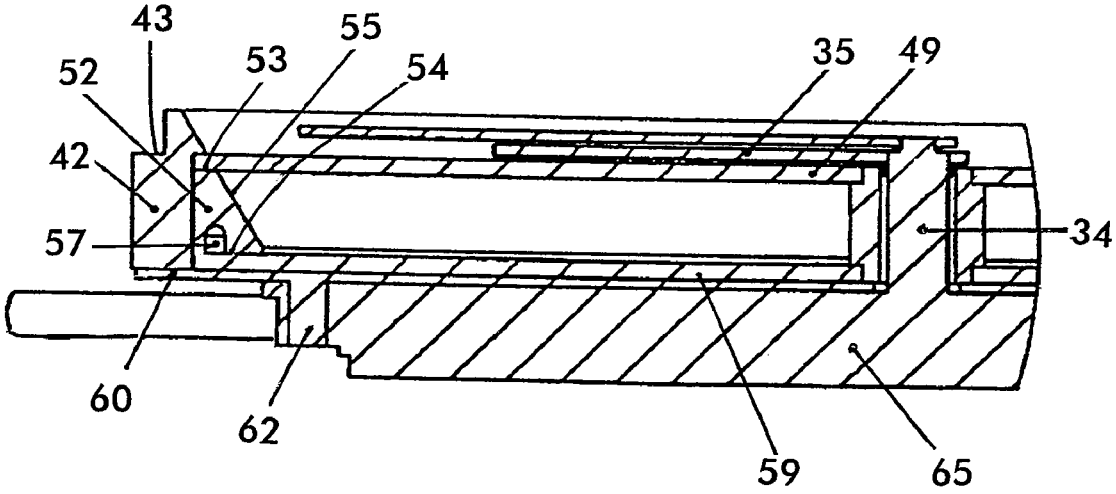
FIG. 5 is an enlarged view of detail 5 of the cross-section of FIG. 4 showing the decorative element container and surrounding watch structures.
Figure 8:
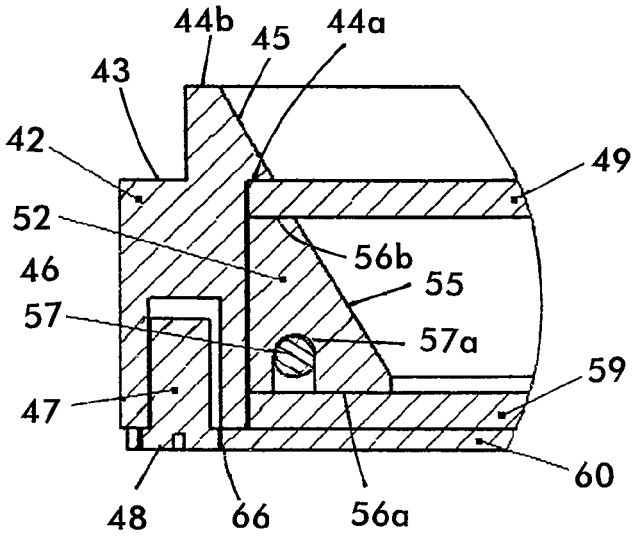
FIG. 8 is an enlargement of detail 7 of FIG. 7.

The decorative element container module 40 may further be secured in the watch by a screw 47 that attaches the outer ring 42 with the back plate 60 of the watch. As shown in FIG. 8, screw 47 may include a lower portion 48 that cooperates with an aperture 66 in back plate 60. Screw 47 is received inside slot 46 of the outer ring 42. Also, as shown in FIG. 3, bottom portion 48 of screw 47 may be positioned inside the movement holder 26 of the watch so that it extends through back plate 60 to secure the outer ring 42 and thereby securing the decorative element container module 40. As shown in FIG. 5, back plate 60 may also include one or more feet, for example two feet, for the watch, that secure the back plate 60 to the movement 65 of the watch. The outer ring 42 may have one, two, three, four or more screws 47, and according to a preferred embodiment includes four screws 47.

Positioned at the hour and minute hand pinions 34 is center collet 36 that may include an upper recess 34*a* and a lower recess 34*b* to secure the upper crystal 49 and the lower crystal 59, respectively. The upper recess 34*a* and the lower recess 34*b* may each be provided as annular grooves that go all the way around on the center collet 34 to provide a secure receiving surface for the upper crystal 49 and the lower crystal 59. Similarly, upper lip 44*a* of the outer ring 42 could be provided as an annular feature for securing the upper crystal 49. In the alternative, such lips and grooves as upper lip 44*a* of the outer ring 42 and upper and lower recess 34*a* and 34*b* of the center collet 34 may be provided only at portions of outer ring 42 and center collet 44 but not provide a simple continuous annular contact surface.

Figure 1:
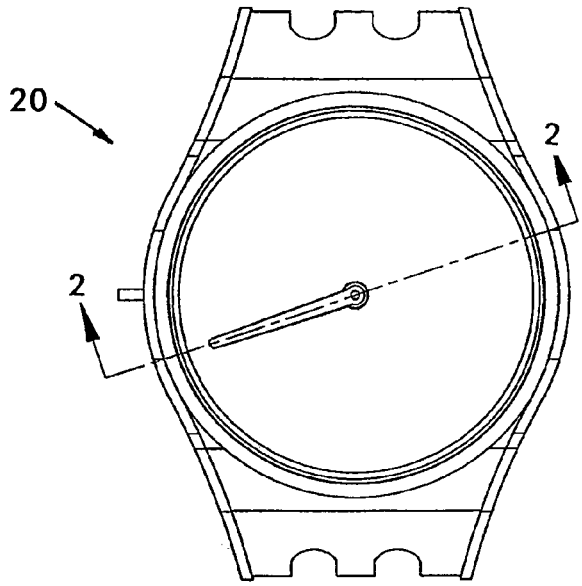
FIG. 1 is a front plan view illustrating a watch with an empty decorative element container according to an aspect of Applicant's invention.

As shown in FIG. 8, outer ring 42 is illustrated as having an annular sloping surface 45, while inner ring 52 is illustrated as also having an annular sloping surface 55. Annular sloping surface 45 of outer ring 42 and annular sloping surface 55 of inner ring 52 can be positioned so that a continuous line or curved surface is provided on either side (above and below) of the upper crystal 49 of the module 40, thus providing a unified appearance and thus providing a reflecting surface to reflect light that enters the watch through the watch crystal to shine over the contents of the decorative element case 41. As illustrated, for example in FIGS. 1 and 6, the annular sloping surface 45 and the annular sloping surface 55, like the inner ring 52 and the outer ring 42 are annular features that ring the dial 39 of the watch 20. Thus, the annular sloping surface 45 of the outer ring and the inner sloping surface 55 of the inner ring 52 can provide for more light and an enhanced appearance for the decorative elements in the decorative element case 41 and can provide the viewing eye for more light reflected back from the contents of the decorative element case 41.

An anti-static coating may also be provided on the lower surface of the upper crystal 49 of the module 40 and on the upper surface of the lower crystal 59 of the module. Such an anti-static coating prevents static-electricity being generated by contact between diamond granules and the upper and lower crystals 49 and 59, respectively, that could interfere with smooth movement of the diamond granules, chips or particles inside a diamond case.

Further, a synergistic effect may be provided if no glue or adhesive is used to secure together the portions of the decorative element container module 40 and portions of the decorative element container module 40 with the watch assembly. Application of the anti-static coating may be interfered with by the presence of the glue or adhesive. Since the features of the decorative element container module above-described provide for a secure assembly of the decorative element container module 40 and a secure positioning of the decorative element container 40 inside the watch, no glue or adhesive need necessarily be used and thus there is no interference with the anti-static coating applied to one or both the upper crystal 49 and the lower crystal 59.

Also, since no glue or adhesive need be used, the decorative element container module 40 may be constructed such that it can be disassembled and the contents of the decorative element case can be removed, replaced or modified as necessary in keeping with fashion trends, demand as expressed by consumers or retailers, or as necessary to effect the repairs, cleaning, alterations and the like.

For example, to disassemble the decorative element container module 40, the watch case back 25 can be removed and the watch movement 65 can be removed in the conventional manner. Following removal of the watch movement 65, and if present the removal of the movement holder which may be provided as an annular ring-shaped structure or may be provided only at portions of the space inside the case body 13, the screw 47 may be removed thus to separate the back plate 60 from the outer ring 42. Once the back plate 60 is removed, the lower crystal 59 can be removed to provide access to the decorative element case and the decorations or decorative elements inside. If necessary, the inner ring 52 and the upper crystal 49 can also be removed, as can the outer ring 42. Assembly of the watch 20 including the decorative element container 40 would be done in a similar manner with the steps reversed.

As illustrated in FIG. 8, inner ring 52 may also include an anti-shock gasket 57 that may include an o-ring or may include other features known in the art to protect against shock. Such an anti-shock gasket may be provided in a groove 57*a* of the inner ring 52, which may be provided as an annular groove of the inner ring 52. It would be understood that features such as the inner 52 and the outer ring 42 may be provided as annular features to secure the upper crystal 49 and the lower crystal 59 which may be provided as discs with a hole in the center for the hour and minute hand pinions 34. However, the inner ring 42 and the outer ring 52 may not necessarily have to extend all the way around the perimeter of the decorative element case 41. For example, it may be sufficient to provide the inner ring 42 and the outer ring 52 only at portions of the perimeter of the decorative element case 41 to secure the upper crystals 49. Also, it would be understood that the inner ring 42 and the outer ring 52 may be integrally formed as a single piece with the above-described features provided in the single piece.

Figure 2:
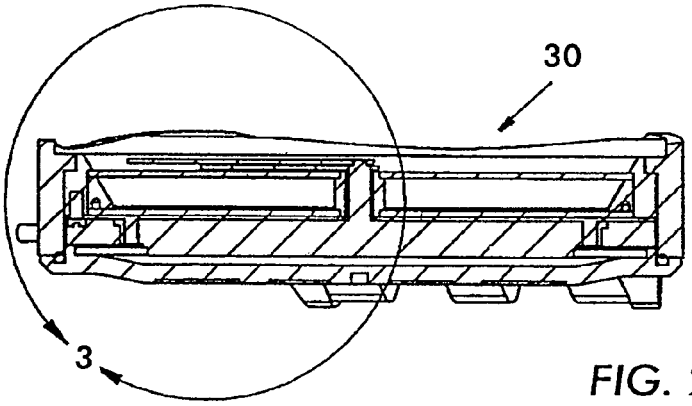
FIG. 2 is a cross-sectional view taken along line 2 of FIG. 1 and illustrates a decorative element container according to an aspect of Applicant's invention.

FIG. 2 is illustrated as being taken along the 2-8 o'clock line of the watch 20. However, it would be understood that the features shown in FIG. 2 may be provided at other cross-sections of the watch 20. As shown in FIG. 6, line 7-7 of the watch 20 may be provided arbitrarily chosen portions of the watch.

While the diamond chips are described herein as freely moving about within the decorative case 41 of the module 40, the diamond chips or granules or any of the other types decorative objects may also be secured in place inside the decorative element case 41, for example to the upper surface of the lower crystal 49, by such means as adhesives or glue or by other fastening means. Also, although described herein throughout as a "watch," it will be understood that the decorative element container module 40 could be similarly incorporated into a clock or other dial-provided instrument and the use of the word "watch" herein includes such clocks and instruments.

Further, since an advantageous securing of the decorative element case 41 is provided by the decorative element container module 40 inside the watch 20, it may be possible to secure the decorative element case without the use of adhesives or glue between elements of the decorative element container module and between the module and the parts of the watch.

Although the present invention has been described in relation to particular embodiments thereof, many other variations, changes in the combination of features, substitutions and modifications and other uses will become apparent to those skilled in the art. It is preferred, therefore, that the present invention be limited not by the specific disclosure herein, but only by the appended claims.

What is claimed is:

1. A decorative element case module forming a decorative element case for a watch with a watch crystal, watch hands, a watch backplate, a watch movement underneath the watch backplate, and a watch case body having an inner upper lip, the decorative element case module comprising:

a lower crystal configured to be positioned on the watch backplate and forming a lower wall of the decorative element case;

an upper crystal configured to be positioned below the watch hands and above the lower crystal, and forming an upper wall of the decorative element case;

an outer ring including:

an outer recess configured to receive the inner upper lip of the watch case body so as to secure the outer ring, and an inner groove configured to receive the upper crystal; and an inner ring configured to be positioned under the upper crystal inside the outer ring and above the lower crystal, the inner ring including an upper portion configured to hold the upper crystal by sandwiching the upper crystal between the upper flat portion and the inner groove of the outer ring.

2. The module of claim 1, wherein the inner ring is comprised of a piece formed integrally separate from the outer ring.

3. The module of claim 1, wherein the inner ring and the outer ring comprise a single piece formed integrally.

4. The module of claim 1, wherein the outer ring comprises a first sloping annular wall extending up from the upper crystal, and the inner ring comprises a second sloping annular wall extending down from the upper crystal, the first sloping annular wall and the second sloping annular wall positioned to provide a unified reflecting surface configured to reflect light to the decorative element container.

5. The module of claim 4, wherein the first sloping annular wall has a same slope as the second sloping annular wall.

6. The module of claim 1, wherein the outer ring is configured to be positioned such that a topmost portion of the first sloping annular wall is at the watch crystal.

7. The module of claim 1, wherein the outer ring comprises a screw configured to secure the outer ring with the watch backplate.

8. The module of claim 1, wherein the inner ring comprises an anti-shock gasket.

9. The module of claim 1, wherein the module is configured to be secured in the watch without adhesive or glue.

10. The module of claim 1, wherein the upper crystal comprises an anti-static coating configured to discharge static electricity.

11. The module of claim 1, wherein the lower crystal comprises an anti-static coating configured to discharge static electricity.

12. The module of claim 1, wherein the decorative element container is disassemblable when the watch backplate is removed so as to facilitate removing and/or replacing of decorative elements contained in the decorative element container.

13. The module of claim 1, wherein the lower crystal includes design elements that provide a watch dial appearance.

14. A watch including a decorative element case module forming a decorative element case for the watch, the watch comprising:

a watch crystal positioned at a top of the watch;

watch hands positioned below the watch crystal, a watch backplate positioned underneath the watch hands;

a watch movement positioned underneath the watch backplate;

a watch case body having an inner upper lip; and the decorative element case module comprising:

a lower crystal configured to be positioned on the watch backplate and forming a lower wall of the decorative element case;

an upper crystal configured to be positioned below the watch hands and above the lower crystal, and forming an upper wall of the decorative element case;

an outer ring including:

an outer recess configured to receive the inner upper lip of the watch case body so as to secure the outer ring, and an inner groove configured to receive the upper crystal; and the inner ring configured to be positioned under the upper crystal inside the outer ring and above the lower crystal, an inner ring including an upper flat portion configured to hold the upper crystal by sandwiching the upper crystal between the upper flat portion and the inner groove of the outer ring.

15. The watch of claim 14, wherein the outer ring comprises a first sloping annular wall extending up from the upper crystal, and the annular ring comprises a second sloping annular wall extending down from the upper crystal, the first sloping annular wall having a same slope as the second sloping annular wall so as to provide a unified reflecting surface configured to reflect light to the decorative element container, wherein the outer ring is configured to be positioned such that a topmost portion of the first sloping annular wall is at the watch crystal.

16. The watch of claim 14, wherein the outer ring comprises a screw configured to secure the outer ring with the watch backplate.

17. The watch of claim 14, wherein the module is configured to be secured in the watch without adhesive or glue, and wherein the decorative element container is disassemblable when the watch backplate is removed so as to facilitate removing and/or replacing of decorative elements contained in the decorative element container.

18. The watch of claim 14, wherein the upper crystal and the lower crystal each comprises an anti-static coating configured to discharge static electricity generated by movement of decorative elements inside the decorative element container.

19. The watch of claim 14, wherein the lower crystal includes design elements that provide a watch dial appearance.

20. A decorative element case module forming a decorative element case for a watch with a watch crystal, watch hands, and a watch backplate, the decorative element case module comprising:

a lower crystal configured to be positioned on the watch backplate and forming a lower wall of the decorative element case;

an upper crystal positioned below the watch hands and forming an upper wall of the decorative element case;

a sloping annular wall positioned beneath the watch crystal at a distal portion of the upper crystal and configured to reflect light to the decorative element case.

21. The module of claim 20, wherein the sloping annular wall comprises a first surface positioned above the upper crystal and a second surface positioned below the upper crystal.

22. The module of claim 21, wherein the first surface has the same slope as the second surface.

* * * * *